United States Patent [19]

Todd

[11] Patent Number: 4,645,206

[45] Date of Patent: Feb. 24, 1987

[54] UNIT POINT SCORING SYSTEM AND SCOREBOARD

[76] Inventor: Alan B. Todd, 2500 N. Vernon St., Arlington, Va. 22207

[21] Appl. No.: 593,575

[22] Filed: Mar. 26, 1984

[51] Int. Cl.[4] ..... A63B 63/08

[52] U.S. Cl. ..... 273/1.5 R; 273/1 ES; 340/323 R

[58] Field of Search ..... 340/323 R; 116/222, 116/242; 273/1 ES

[56] References Cited

U.S. PATENT DOCUMENTS

| | | | |
|---|---|---|---|
| 3,638,215 | 1/1972 | Payne | 340/323 R |
| 3,683,357 | 8/1972 | Presnick et al. | 340/323 R |
| 3,981,002 | 9/1976 | Gardner | 340/323 R |

*Primary Examiner*—John W. Caldwell, Sr.

*Assistant Examiner*—Mahmoud Fatahi-yar

*Attorney, Agent, or Firm*—Spencer & Frank

[57] ABSTRACT

A unit point scoring system and scoreboard for use with a series of athletic games or other contests in even or odd numbers, or a single athletic game or other contest that is divided into even or odd numbered units of play. The individual competitions in a series or the individual units in a single contest are scored in the traditional manner, but the unit point scoring system takes the scoring history into account in order to maintain the competitive urge in contestants and interest in spectators by providing for the award of points for units of play won under a formula that positions both contestants in such a way that neither can be determined the winner before the conclusion of the series or single contest.

10 Claims, 8 Drawing Figures

UNIT POINT SCORING SYSTEM AND SCOREBOARD

BACKGROUND OF THE INVENTION

The present invention relates to a scoring system for use during contests, and more particularly to a unit point scoring system and scoreboard for use either during a series of competitions or for use during a single contest which is divided into units of play. The invention is particularly adapted for use during athletic events which occur in a series, such as the World Series of baseball, or during athletic games which are divided into units, such as the four quarters of a football game. In addition to team contests the invention is applicable to individual contests, such as a boxing or tennis match.

Contests such as athletic events are frequently played in a series in order to determine an eventual winner. For example in a series of three athletic events, the winner of two games would be declared the winner of the series. Similarly, the winner of three games would be declared the winner of a series of five, or the winner of four games would be declared the winner of a series of seven. Ideally the outcome of such a series is not settled until the last game, thereby maintaining the interest of spectators and contestants alike. All too frequently, however, the two-out-of-three, three-out-of-five, or four-out-of-seven determination of the winner of a series of competitions results in a "short series" in which the winner is determined before all of the allotted games of the series had been played. Where less than the maximum number of games are played in such a series there is not only disappointment on the part of contestants and spectators alike, there is also a complete loss of income and employment which could have resulted had all of the games been played. The premature truncation of a series that is televised also disrupts the programming of the television networks and frequently subjects the television public to unscheduled re-runs in lieu of the mounting excitement which they had anticipated.

The uneven number of games now set in most sports for play-off and championship series also results in inequitable division of home-field advantage to one side or the other, and requires involved considerations of past records of play. Scheduling an even number of such games on a home-and-home basis (all of which would be played), would not only overcome such inequities but also greatly simplify the task of scheduling, ticket selling and distribution, and setting up the broadcast coverage for TV and radio.

Traditional scoring methods also leave something to be desired in single games that can be divided into units. For example, there is something distinctly artificial about bestowing victory on a football team that has performed creditably enough during three quarters but that is exhausted and outscored during the fourth quarter by a competing team that just seems to be hitting its stride. In such a situation, under traditional scoring methods the weaker team might be declared the victor due to points acquired early in the game, when the contestants were fresh, even though it might be clear to contestants and spectators alike that the team with the lower number of total points was nevertheless the superior team. Moreover in games such as football the score might become lopsided early in the event due to a few lucky plays, thereby demoralizing the trailing team and undermining its efforts to compete vigorously during the entire game. If, however, each division or unit of the game were to be played and scored separately to win, lose or tie, there would be greater opportunity for both contestants to be "in the game" for the entire contest.

SUMMARY OF THE INVENTION

Accordingly, a primary object of the present invention is to avoid these problems in the prior art by providing a scoring system and scoreboard that will keep the contestants on a more or less equal basis all during play of a game or series of games so that the winner cannot be determined until all units within a game or all games within the series are completed.

Another object of the present invention is to maintain a high level of competitive urge in the players all during a game or series of games, and a high level of spectator interest throughout all units of play as well.

Another object of the present invention is to avoid the economic loss that accompanies a short series.

Another object is to provide series play in an even instead of odd number of games in order to equalize home-field advantage and simplify scheduling and other administrative functions.

Another object of the present invention is. to avoid hopelessly lopsided scores during athletic events or nonathletic contests such as television quiz shows.

These and other objects can be attained by making victory depend not only upon the total number of games won in a series or points scored during individual units of a single game, but also upon the scoring history. That is, the value of the points won by a contestant depends upon the historical context in which those points were acquired. Under the unit point scoring system the units within a game or games within a series are all played and scored separately to win, lose or tie, and one or more unit points are awarded for each unit won. The units in a game or games in a series may be any number, even or odd, with the winner being the contestant who has scored the most unit points after the last unit in a game or the last game in a series has been completed. Under certain circumstances the winner is not determined until extended units or extended games are completed. Because of the special formula applied under this system for awarding and recording extra or bonus unit points, neither contestant can get so far ahead in unit points during a game or series that the opponent cannot catch up and pass the other by the time the last unit or game is completed. There is always the possibility and anticipation that either contestant may win the game or series of games no matter how far ahead or behind in unit points either contestant may be.

The historical component of the unit point scoring system has the advantage of conforming to ordinary expectations during everyday life. For example a boxer or tennis player who performs well early in a match may nevertheless be near collapse at the end, and in such a situation the early performance is overshadowed by later developments. Unit point scoring acknowledges continued improvement in play through the award of an extra or bonus point to a winner who had previously lost.

DESCRIPTION OF THE PREFERRED EMBODIMENT

Figure 1A:
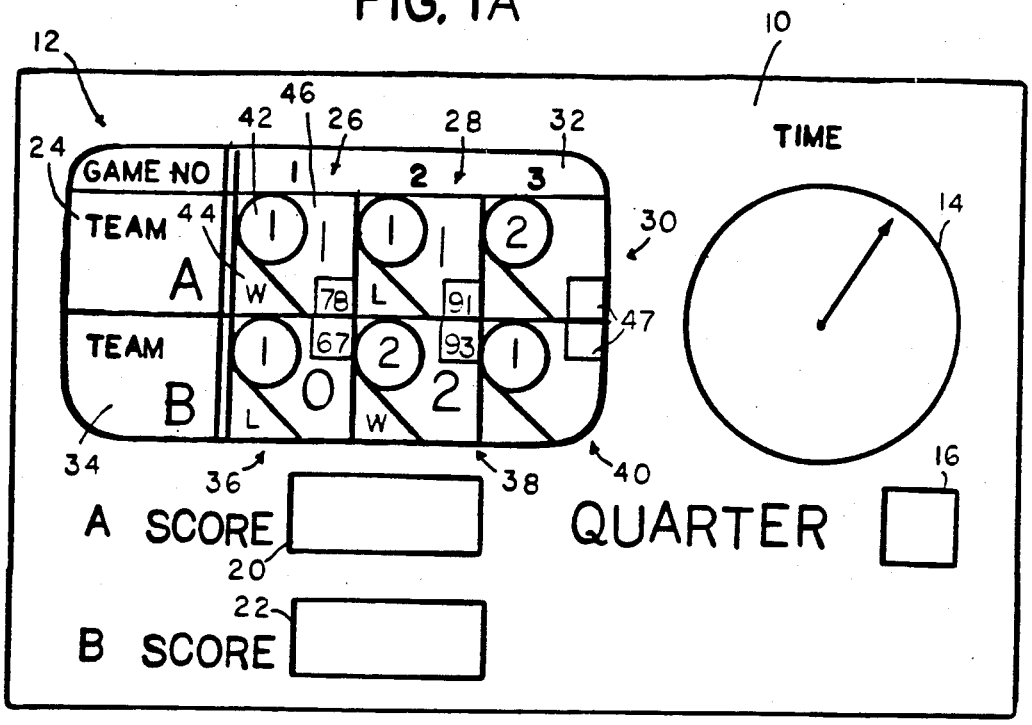
FIG. 1A is a front view of a typical basketball scoreboard modified to have a region thereof devoted to unit point scoring for a three-game series.

FIG. 1A illustrates a basketball scoreboard 10 having a unit point scoring portion 12. Scoreboard 10 includes the indicators typically found on basketball scoreboards, including time indicator 14, quarter indicator 16, and scoring indicators 20 and 22 for displaying the scores of basketball teams A and B, respectively. Indicators 14–22 may be mechanical, such as a mechanical clock for time indicator 14 and exchangeable number plates for indicators 16–22, or they may be provided by matrices of selectively illuminated lamps to display the necessary digits. Of course additional indicators may be found on a traditional basketball scoreboard to display other relevant statistics.

With continued reference to FIG. 1A, scoreboard 10 is configured for a series of three basketball games, two of which have been completed. Team identifying area 24 is positioned to identify game block regions 26, 28 and 30 with team block A. It will be apparent from game identifier area 32 that game block region 26 pertains to team A's outcome on the first game of a three game series, that region 28 pertains to team A's outcome on the second game of the series, and that region 30 pertains to team A's outcome on the third game of the series. Similarly, team identifier area 34 associates game block regions 36, 38, and 40 with team B for the first, second, and third game, respectively. Like indicators 14–22, game block regions 26–30 and 36–40 may be provided by exchangeable plates or by matrices of selectively illuminated lamps, etc. Areas 24, 26, and 34 may also be provided by exchangeable plates or light matrices, or they may be painted.

With continuing reference to FIG. 1A, each game block region of unit point scoring portion 12 is in turn divided into four portions 42, 44, 46, and 47. In FIG. 1A at-stake portion 42 is illustrated as being circular in shape, but it may of course have other geometrical shapes or be demarcated from the remainder of the game block region in some other manner, such as by the use of different colors. The contents of the at-stake portions are known before a game begins, and depend upon the history of the series. For both teams A and B the at-stake portions 42 in game block regions 26 and 30 contain "1," since these game block regions pertain to the first game of the series. The contents of the at-stake portions 42 for the remaining game block regions are based upon the history of the series, and will be determined at the end of the previous game, as will be described. Outcome portions 44 are illustrated in FIG. 1A as being triangular in shape but these portions, also, may have different geometrical configurations or be demarcated in some other way. The contents of outcome portions 44 are determined after a game has been played. In the drawings "W" indicates a win, "L" indicates a loss, and "T" indicates a tie. Unit point portions 46 are illustrated as being irregular in shape but these portions, like portions 42 and 44, may have some other geometrical configuration or may employ some other way of distinguishing the contents of these portions from the other portions of the game block region. Unit point portions 46 cumulatively contain unit point scores which depend upon the current game's outcome, the number of unit points that the team had at stake in that game, and the team's unit points before that game. Additional outcome portions 47 may also be included as a supplement to outcome portions 44. Portions 47 show the points scored in each unit by each team or contestant under the traditional rules of the game being played. Although additional outcome portions 47 are illustrated as squares in FIG. 1A they may, of course, have different configurations. It will be apparent that, if desired, outcome portions 44 may be omitted from a scoreboard which includes additional outcome portions 47, since portions 44 and 47 both provide information about the results of a given competition. The scoring will be described in more detail in the following paragraphs.

With continuing reference to FIG. 1A, it is assumed that team A won the first game and that team B lost the first game. This is depicted in outcome portions 44 of game block regions 26 and 36. The score—assumed to be a 78–67 victory by team A—is illustrated in additional outcome blocks 47. The outcome of the first basketball game is determined in the normal manner, as is suggested by the fact that most of the indicators on scoreboard 10 are the traditional ones. In fact one of the advantages of the unit point scoring system is that the winners of units in a game or games in a series of games are decided by the greatest number of goals, runs, or points scored in that unit or game by either contestant under the normal rules of the game being played, i.e., baseball, football, basketball, hockey, soccer, tennis, television quiz. game, etc. In view of the fact that team A is assumed to have won the first game of the three game series, team A is awarded a "1" in unit point portion 46 of game block region 26. At this point the contents of at-stake portions 42 of game block regions 28 and 38 can be determined. Since team A won the first game, it has only one unit point at stake in the second game and accordingly a "1" is placed in the at-stake portion for team A before the second game begins. Since team B lost the first game, it has two unit points at stake in the second game. In FIG. 1A it is assumed that team A lost the second game by a score of 91–93, thereby retaining its previous unit point (illustrated as "1" in unit point portion 46 of block 28) but not being entitled to the additional point that the team had at stake in the second game. Team B, which is assumed to have won the second game, is awarded the two unit points that it had at stake. FIG. 1A illustrates the contents of unit point scoring portion 12 after the second game, and before the third game has been completed. At this point the contents of the at-stake portions for the third game can be determined. Since team A lost game two, during game three it has at-stake a unit point, for game three plus a bonus unit point for each game lost since its previous win, or two unit points. Team B, on the other hand, has only a single unit point at stake in game three.

From the foregoing it will be apparent that one unit point is awarded to the winner of the first unit in any game or the first game in any series. One unit point is always awarded for each subsequent unit won in a game or each subsequent game in the series of games, unless the winner of the current unit or game lost the immediately previous unit or game. In this case bonus points will be awarded the current winner, one bonus point for each consecutive unit or game that the current winner had lost. On the other hand the number of points for winning a unit or game after winning the immediately previous unit or game is always "1." In this way a historical dimension is imparted to the scoring, since the number of unit points to be awarded the victor of any particular game or unit is determined by the prior history of the contest, with the winner of a current game having fewer unit points at-stake in the next game. As has been described, for every unit of a game or game of a series, the winner is awarded one point plus a bonus point for every unit he has lost since his previous win in the game or series. A "win" breaking a string of previous losses, for example, would be rewarded by a point for the win in addition to a bonus point for each loss in the string. Examples of this scoring procedure will be illustrated below with reference to FIGS. 18–7. In order to promote clarity in these Figures the additional outcome portions 47 have not been illustrated except in FIG. 1B, although it will be apparent that they could be present if desired.

Figure 1B:
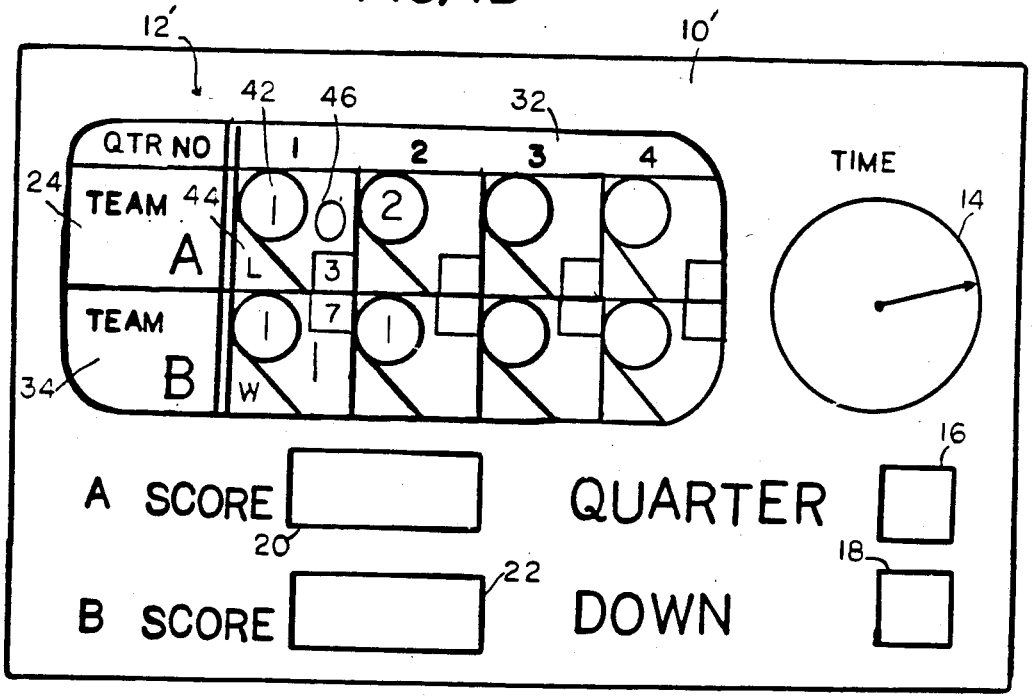
FIG. 1B is a front view of a typical football scoreboard modified to have a region thereof devoted to unit point scoring for the quarters of the game.

FIG. 1B illustrates a scoreboard 10' that is configured as a football scoreboard for use during a single game between teams A and B. In addition to a time indicator 14, quarter indicator 16, and scoring indicators 20 and 22, scoreboard 10' includes a down number indicator 18. The identifier area 32 of unit point scoring portion 12' identifies the first, second, third, and fourth quarters. In unit point scoring the quarters are treated as a series of individual competitions, each quarter being scored separately under the traditional football scoring rules. FIG. 1B shows scoreboard 10' after completion of a first quarter in which team A scored a field goal and team B scored a touchdown and the point after. Accordingly team A has two unit points at stake in the second quarter, while team B only has one unit point at stake.

Figure 2:
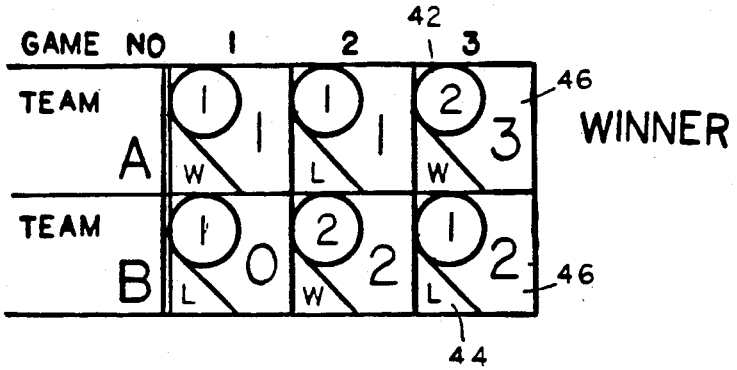
FIG. 2 illustrates the unit point scoring system portion of the scoreboard of FIG. 1A after completion of the third game.

FIG. 2 illustrates an example of unit point scoring portion 12 of FIG. 1A (less portions 47) after completion of the third game, assumed to have been won by team A. Having won the third game, as indicated by the "W" contained in outcome portion 44 of team A's third game block region, team A is awarded the two unit points it had at-stake, indicated by the "2" contained within at-stake portion 42 of team A's third game block region. These two points are added to the one unit point that was previously awarded to team A. Accordingly, "3" is contained in unit point portion 46 of the third game block region for team A. In contrast, team B lost the third game and was not awarded the single unit point that it had at stake during that game, and consequently the unit point portion of the third game block region for team B contains "2." Since team A had more unit points at the end of the series, it is declared the winner of the series.

Figure 3:
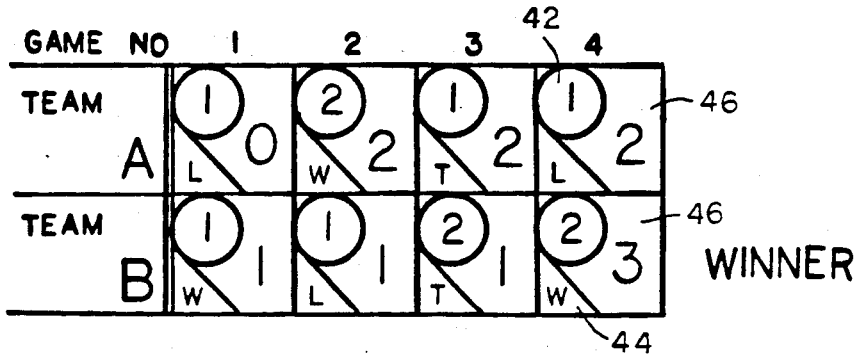
FIG. 3 illustrates an example of a unit point scoring portion of a scoreboard for a four-game series or a single game having four quarters.

FIG. 3 illustrates a unit point scoring portion suitable for use with a four game series. In FIG. 3 each team had a single unit point at stake in the first game (as indicated by the "1" contained in the at-stake portions of the first game block regions), and team B is assumed to have won the first game. This is indicated by the "L" and "W" in the triangular outcome portions 44 of the first game block regions. Accordingly, team B is awarded a "1" in unit point portion 46 of its first game block region, while team A does not receive any unit points for the first game. Having lost the first game, team A has two unit points at stake in the second game while team B has only one unit point at stake. Assuming that team A wins the second game, team B will have a total of one unit point at the end of the second game while team A will have a total of two unit points. With this history team A will have only one unit point at stake in the third game, while team B will have two unit points at stake. The third game is assumed to be a tie (including a scoreless tie) so neither team wins any unit points and the possible unit points set for winning the third game are carried on over to the last game. That is, the third game is effectively removed from the series. In the fourth game, each team has the same number of unit points at stake that were at stake in the third game. If team B wins the fourth game, it is the winner of the series.

Figure 4:
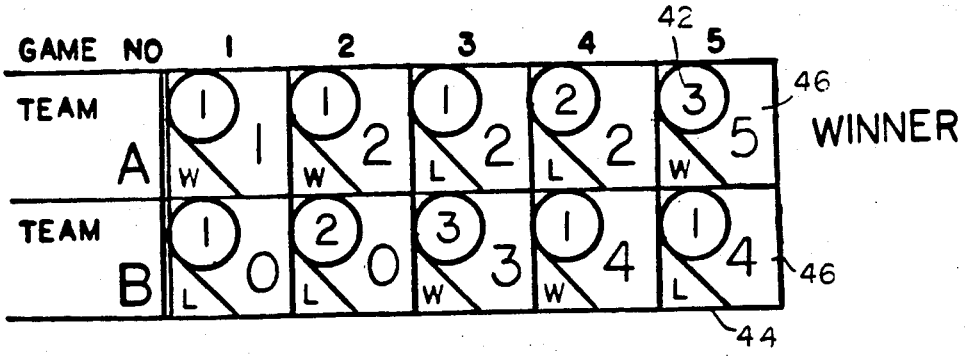
FIG. 4 illustrates an example of the unit point scoring portion of a scoreboard for a five-game series or a single game having five units.
Figure 5:
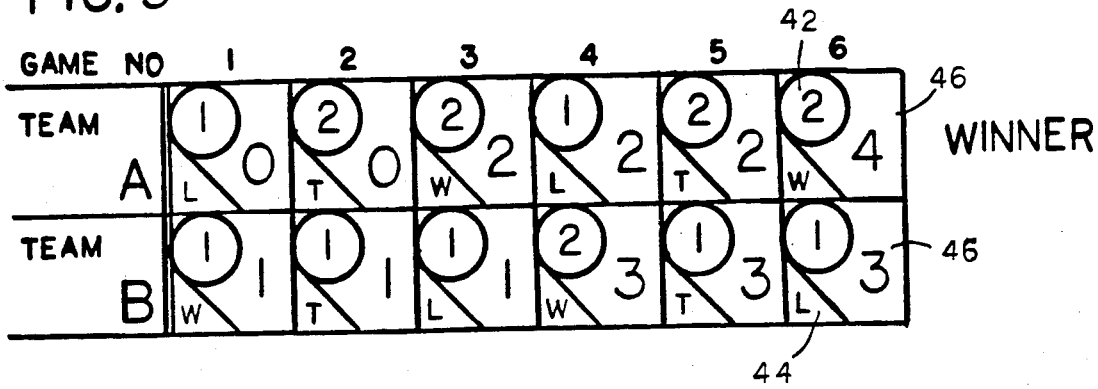
FIG. 5 illustrates an example of the unit point scoring portion of a scoreboard for a series having six games or a single game having six units.

FIGS. 4 and 5 illustrate the unit point scoring portions of a scoreboard for five and six game series, respectively, or for single games having five or six units, respectively.

The contestant with the most unit points at the end of the game or at the end of the series of games is declared to be the winner, unless play is extended. A framework for extended play is set forth below, with the examples illustrated in FIGS. 6 and 7. The extension option avoids an incongruous outcome in the event that a competing entity wins a large number of unit points in the last unit or game following a string of previous losses. General considerations of fairness require that one competing entity should win at least as many units or games as the other in order to be entitled to victory, and one or more extended units or games provide the vehicle whereby a competing entity that is ahead in unit points but behind in the number of wins upon completion of a series can attempt to even up the number of wins. In general, play is not extended unless there are at least three games in the series or three units in a game. In such a situation if the contestant with the largest number of unit points has only won a single game or unit, play is extended for another game or unit. If the contestant with the largest number of unit points has only won one game or unit out of four, play is extended for up to two additional games or units. The second additional game or unit need not be played, of course, if the contestant that won only one out of four loses the first additional game or unit. If there are five games in the series or units in the game and the contestant with the largest number of unit points has only won two of them, play is extended for an additional game or unit. If the player with the largest number of unit points after completion of five games or units has only won one of them, play is extended for up to an additional three games or units. This scheme is extended for a series with more games or a game with more units, so that the contestant that has won the lesser number of units or games at the end of the series or game must win at least the same number of units or games as his opponent in order to be declared the overall winner. Thus if the contestant with the largest number of unit points after a six-game series has won only two of the games, play is extended for up to an additional two games. If that contestant has only won one of the six games, play is extended for up to an additional four games. Similarly, if the contestant with the largest number of unit points following a seven-game series has only won three of the games, play is extended for an additional game; if that contestant has only won two of the seven games, play is extended for up to three additional games; and if the contestant has only won one of the seven games, play is extended for up to five more games. Of course the same extension procedures which apply to games of a series also apply to units of a game.

Figure 6:
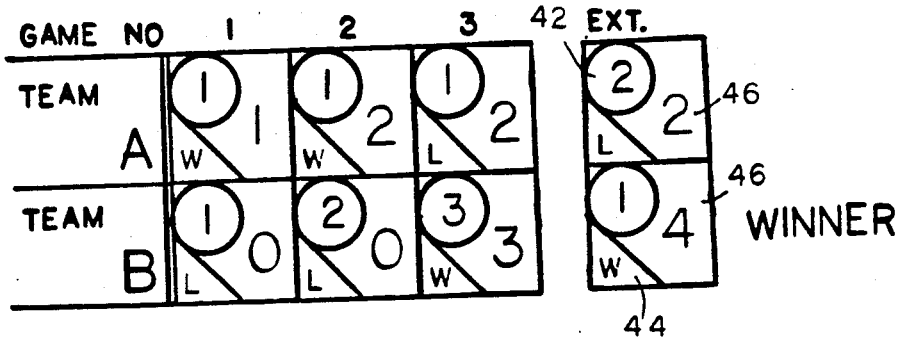
FIG. 6 illustrates an example of the unit point scoring portion of a scoreboard for a three-game series or three unit game having one extension.

FIG. 6 illustrates a situation in which team B has three unit points at the end of a three-game series but has only won the last game. Accordingly, the series is extended by a game. In the extended game, team B has one unit point at stake while team A, which lost game three of the series, has two unit points at stake. Assuming that team B wins the extended game, it will have four unit points and be declared the winner of the series.

Figure 7:
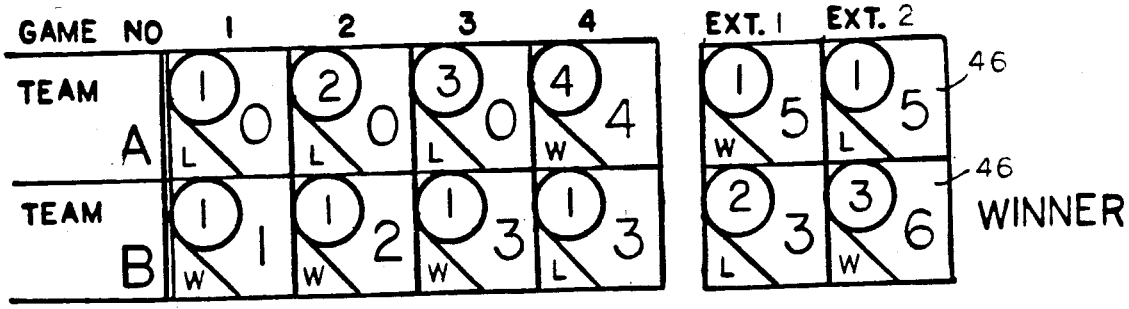
FIG. 7 illustrates an example of the unit point scoring portion of a scoreboard for a four-game series or four unit game having two extensions.

FIG. 7 illustrates a situation in which team A has only won the last quarter of a game or the last game of a four-game series, but has the greatest number of unit points. Play is extended for up to an additional two games or units, thus giving team B, which has won the majority of units or games, two more chances to win the game or series. Team A has one unit point at stake in the first extension and, assuming that team A wins that extension, one unit point at stake in the last extension. Having lost the fourth game or unit, team B has two unit points at stake in the first extension. Assuming that team B loses the first extension, it will have three unit points at stake in the second extension. If team B wins the second extension, it will be declared the ultimate winner, as illustrated.

Where the possible number of extended units or games is more than one, the winner of the extended-unit game or the extended-game series is the contestant who wins any extended unit or game which gives him a majority of the units or games won to that point in the game or series; or the contestant with the most unit points at the end of the last extended unit or game.

The foregoing description has explained a unit point scoring system and scoreboard for use in athletic events and other contests such as television quiz shows, etc. It will be apparent that the unit point scoring system employs both current scores and the scoring history of the contestants in order to avoid "short series" contests and to maintain a sustained level of competition by contestants and interest by spectators, since neither contestant can get so far behind that ultimate victory is impossible. It rewards the achievement of overcoming the difficulty of winning after losing. It delays determination of the winner of a series of either odd or even numbered units of play until completion of the entire series of units. The unit point scoring system extends traditional scoring practices while allowing them to be applied in their normal manners, depending upon the contest, within individual units of a game or games of a series.

What I claim is:

1. A method for scoring a contest between a first competing entity and a second competing entity, the contest being divisible into a plurality of separate competitions that occur in sequence, comprising the steps of:

(a) placing a predetermined number of contest points at stake for each competing entity prior to the beginning of the first competition of the sequence, and displaying such number of contest points;

(b) determining which competing entity won the first competition of the sequence;

(c) awarding said predetermined number of contest points to the winner of the first competition of the sequence;

(d) prior to the beginning of the following competition in the sequence, determining the number of contest points to be placed at stake for each competing entity on the basis of the outcome of at least one prior competition of the sequence, and displaying the number of contest points to be placed at stake for each competing entity;

(e) determining which competing entity won said following competition;

(f) awarding to the winner of said following competition the contest points it had at stake in said following competition;

(g) repeating steps (d) through (f) until said sequence is exhausted; and (h) thereafter declaring, as victor of the contest, the competing entity that has acquired the greatest number of contest points.

2. The method of clam 1, wherein step (d) comprises the step of determining the number of contest points to be placed at stake for each competing entity by adding a predetermined number of contest points for said following competition to at least one bonus contest point for each competition in the sequence that said competing entity has lost since its last win.

3. The method of claim 2, further comprising the step of expanding said sequence by up to a predetermined number of extension competitions, said predetermined number being at least one, if the competing entity with the greatest number of contest points upon completion of said sequence has won fewer than a predetermined number of competitions of said sequence.

4. The method of claim 3, wherein the step of expanding said sequence comprises the step of expanding said sequence by one competition if the competing entity with the greatest number of contest points upon completion of a sequence of three competitions only won one of said three competitions.

5. The method of claim 3, wherein the step of expanding said sequence comprises the step of expanding said sequence by up to two competitions if the competing entity with the greatest number of contest points upon completion of a sequence of four competitions only won one of said four competitions.

6. The method of claim 3, wherein the step of expanding said sequence comprises the step of expanding said sequence by up to three competitions if the competing entity with the greatest number of contest points upon completion of a sequence of five competitions only won one of said five competitions and expanding said sequence by one competition if the competing entity with the greatest number of contest points upon completion of said sequence of five competitions only won two of said five competitions.

7. The method of claim 2, wherein the step of expanding said sequence comprises the step of expanding said sequence by up to four competitions if the competing entity with the greatest number of contest points upon completion of a sequence of six competitions only won one of said six competitions and expanding said sequence by up to two competitions if the competing entity with the greatest number of contest points upon completion of said six competitions only won two of said six competitions.

8. The method of claim 7, wherein the step of expanding said sequence comprises the step of expanding said sequence by up to five competitions if the competing entity with the greatest number of contest points upon completion of a sequence of seven competitions only won one of said seven competitions, expanding said sequence by up to three competitions if the competing entity with the greatest number of contest points upon completion of said seven competitions only won two of said seven competitions, and expanding said sequence by one competition if the competing entity with the greatest number of contest points upon completion of said sequence of seven competitions only won three of said seven competitions.

9. The method of claim 3, wherein the step of expanding said sequence comprises the step of expanding said sequence by a number of competitions that would require the competing entity with the greatest number of contest points upon completion of said sequence to win at least as many competitions as the other competing entity in order to win the contest.

10. The method of claim 3, wherein the step of expanding said sequence comprises the step of terminating said contest prior to completion of all of said predetermined number of extension competitions if at any point after completion of a first extension competition a competing entity has won a majority of all competitions already completed, the winner of said contest being the competing entity that won said majority of all competitions already completed if the contest is terminated prior to completion of all of said predetermined number of extension competitions and otherwise being the competing entity with the most competition points upon completion of said predetermined number of extension competitions.

* * * * *